US009635893B2

(12) United States Patent
Mak

(10) Patent No.: US 9,635,893 B2
(45) Date of Patent: May 2, 2017

(54) GLOVE

(71) Applicant: Sureguard Safety Products Limited, Hong Kong (HK)

(72) Inventor: Anthony Hang Kwong Mak, Hong Kong (HK)

(73) Assignee: SUREGUARD SAFETY PRODUCTS LIMITED, Hong Kong (HK)

( * ) Notice: Subject to any disclaimer, the term of this patent is extended or adjusted under 35 U.S.C. 154(b) by 226 days.

(21) Appl. No.: 14/312,699

(22) Filed: Jun. 24, 2014

(65) Prior Publication Data

US 2014/0373576 A1 Dec. 25, 2014

Related U.S. Application Data

(60) Provisional application No. 61/838,363, filed on Jun. 24, 2013.

(51) Int. Cl.
*A41D 13/00* (2006.01)
*A41D 19/00* (2006.01)
*A41D 19/015* (2006.01)

(52) U.S. Cl.
CPC ..... *A41D 19/01523* (2013.01); *A41D 19/015* (2013.01); *A41D 19/01529* (2013.01); *A41D 19/01576* (2013.01)

(58) Field of Classification Search
CPC ..... A41D 19/01523; A41D 19/01529; A41D 19/015; A41D 19/01576
USPC ..... 2/164, 167, 159, 161.1, 161.6, 16, 20; 482/36.1, 36.2; 66/174
See application file for complete search history.

(56) References Cited

U.S. PATENT DOCUMENTS 964,608 A * 7/1910 Chaddock ..... A41D 19/015 2/161.6
2,578,188 A * 12/1951 Cochran ..... A41D 19/01529 2/16
3,548,413 A * 12/1970 Jackson ..... A41D 19/01529 2/16
4,172,293 A * 10/1979 Vistins ..... A41D 13/04 156/280
4,441,213 A * 4/1984 Trumble ..... A41D 19/0058 2/16
4,663,783 A * 5/1987 Obayashi ..... A41D 19/01529 2/161.1

(Continued)

FOREIGN PATENT DOCUMENTS

CN 2666208 Y 12/2004

OTHER PUBLICATIONS

1st Office Action of counterpart Chinese Patent Application No. 201410282836.5 issued on Nov. 22, 2016.

*Primary Examiner* — Khoa Huynh
*Assistant Examiner* — Katharine Gracz

(57) ABSTRACT

A glove includes a first part to cover the back side of a hand and a second part to cover the palm side of the hand. The first part and the second part form a space for placing the hand. The first part includes an outermost flame retardant polyester spandex layer, a thermoplastic polyurethane waterproof membrane adjacent to the flame retardant polyester spandex layer, an innermost cotton polyester knit layer, and a dual density pad layer made of ethylene vinyl acetate and low density polyethylene sandwiched between the thermoplastic polyurethane waterproof membrane and the cotton polyester knit layer.

9 Claims, 10 Drawing Sheets

(56) References Cited

U.S. PATENT DOCUMENTS 4,679,257 A * 7/1987 Town ..... A41D 19/0006 2/159
5,187,814 A * 2/1993 Gold ..... A41B 11/00 2/160
6,571,397 B1 * 6/2003 Williams ..... A41B 11/005 156/212
6,591,427 B1 * 7/2003 Bennett ..... A41D 19/01529 2/161.6
6,839,912 B2 * 1/2005 Lewis ..... A41D 19/01529 2/161.6
7,832,020 B2 * 11/2010 Grilliot ..... A41D 19/01529 2/161.1
8,256,030 B2 * 9/2012 Williams ..... A41D 19/0006 2/161.6
2003/0221235 A1 * 12/2003 Lewis ..... A41D 19/01529 2/16
2004/0049942 A1 * 3/2004 Chen ..... A43B 7/125 36/3 A
2005/0076418 A1 * 4/2005 von Blucher ..... A41D 19/015 2/161.6
2006/0048268 A1 * 3/2006 Loos ..... A41D 19/01529 2/161.6
2006/0156452 A1 * 7/2006 Schierenbeck .. A41D 19/01529 2/161.6
2008/0282439 A1 * 11/2008 Sarkies ..... A41D 19/01 2/20
2009/0222980 A1 * 9/2009 Klug ..... A41D 19/01529 2/455
2009/0304759 A1 * 12/2009 Howard, Jr. ..... A01N 25/34 424/402
2010/0223709 A1 * 9/2010 Crye ..... A41D 13/065 2/16
2011/0113538 A1 * 5/2011 von Blucher ..... A43B 1/00 2/456
2012/0311754 A1 * 12/2012 Safford ..... A41D 19/015 2/20

* cited by examiner

GLOVE

CROSS-REFERENCE TO RELATED APPLICATIONS

This application claims the benefit of U.S. Provisional Application No. 61/838,363, filed on Jun. 24, 2013, the entire content of which is hereby incorporated by reference.

FIELD OF TECHNOLOGY

The present patent application relates to a glove, and particularly to an impact-resistant glove.

BACKGROUND

Gloves are commonly used for labor protection, playing a role in protecting hands and preventing hands from hurt during operation. In some workplaces where collision or impact may occur, common gloves are weak in enduring collision or impact, and cannot provide good protection.

SUMMARY

The present patent application provides a glove, which has a good impact resistance and provides protection to the hands of an operator.

The present patent application provides a glove including a first part to cover the back side of a hand and a second part to cover the palm side of the hand. The first part and the second part form a space for placing the hand. The first part includes an outermost flame retardant polyester spandex layer, a thermoplastic polyurethane waterproof membrane adjacent to the flame retardant polyester spandex layer, an innermost cotton polyester knit layer, and a dual density pad layer made of ethylene vinyl acetate and low density polyethylene sandwiched between the thermoplastic polyurethane waterproof membrane and the cotton polyester knit layer.

In one embodiment, the dual density pad layer may include a higher density layer adjacent to the thermoplastic polyurethane waterproof membrane and a lower density layer adjacent to the cotton polyester knit layer. The density of the higher density layer is higher than that of the lower density layer.

In one embodiment, the outer surface of the higher density layer of the dual density pad layer may have lateral protrusions extending laterally.

In one embodiment, the dual density pad layer may include a back portion, four finger portions at the front of the back portion, and a thumb portion separated from the back portion.

In one embodiment, the finger portion may have a curved cross-section half surrounding the back side of the finger.

In one embodiment, the outer surface of the first part may have longitudinal protrusions extending longitudinally.

In one embodiment, the second part may include an outermost flame retardant cotton canvas layer, an innermost cotton polyester knit layer, and a thermoplastic polyurethane waterproof membrane sandwiched between the flame retardant cotton canvas layer and the cotton polyester knit layer.

Embodiments of the present patent application have the following advantages: the first part of the glove of the present patent application for covering the back side of hand is made of multi-layers of materials. The dual density pad layer made of ethylene vinyl acetate and low density polyethylene sandwiched between the thermoplastic polyurethane waterproof membrane and the cotton polyester knit layer provides excellent impact resistance and absorption of shock and protects hands. In addition, since the glove has a flame retardant layer on the outside and a waterproof membrane on the inside, it has both flame retardant and waterproof properties.

BRIEF DESCRIPTIONS OF THE DRAWINGS

The present patent application will be further described below by way of example with reference to the accompanying drawings wherein.

DETAILED DESCRIPTION

Figure 1:
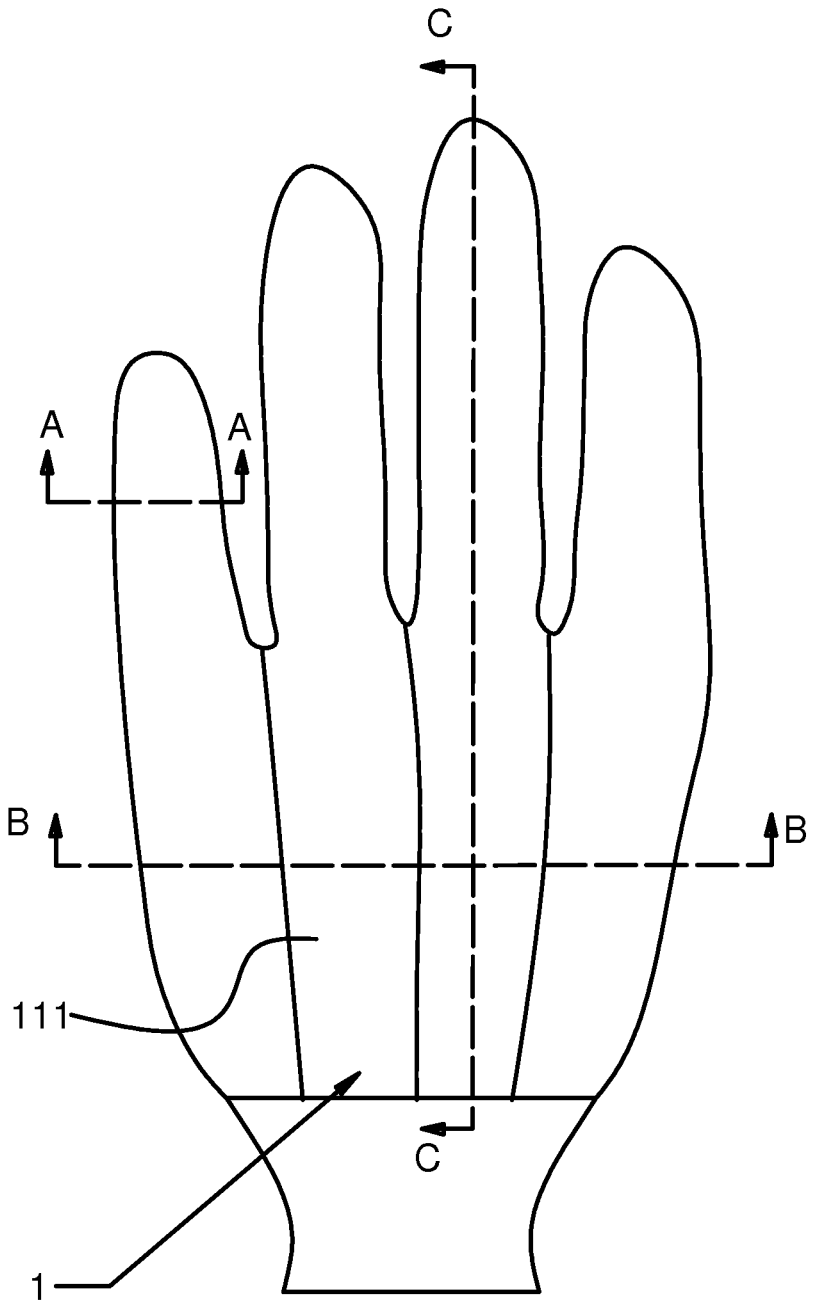
FIG. 1 is a schematic diagram of the back side of a left-hand glove according to an embodiment of the present patent application.

In the following detailed description, numerous specific details are set forth to provide a thorough understanding of claimed subject matter. However, it will be understood by those skilled in the art that claimed subject matter may be practiced without these specific. In other instances, methods, apparatuses, or systems that would be known by one of ordinary skill have not been described in detail so as not to obscure claimed subject matter.

Embodiments of the glove of the present patent application are described below in detail. Examples of these embodiments are shown in the drawings, wherein the same or similar numerals represent the same or similar elements or elements having the same or similar functions.

In the description of the glove of the present patent application, the terms "front", "back", "above", "below", "upper", "lower", "top" and "bottom" indicate an orientation or position relationship based on the orientation and position relationship as indicated in the drawings, merely to facilitate and simplify description of the present patent application, do not indicate or imply that a device or element referred to necessarily has a specific orientation, being made or operated with a specific orientation, and thus should not be understood as a limitation to the present patent application. In addition, the terms "first" and "second" are merely used for description purposes, and therefore should not be understood as an indication or implication of the relative importance.

Figure 2:
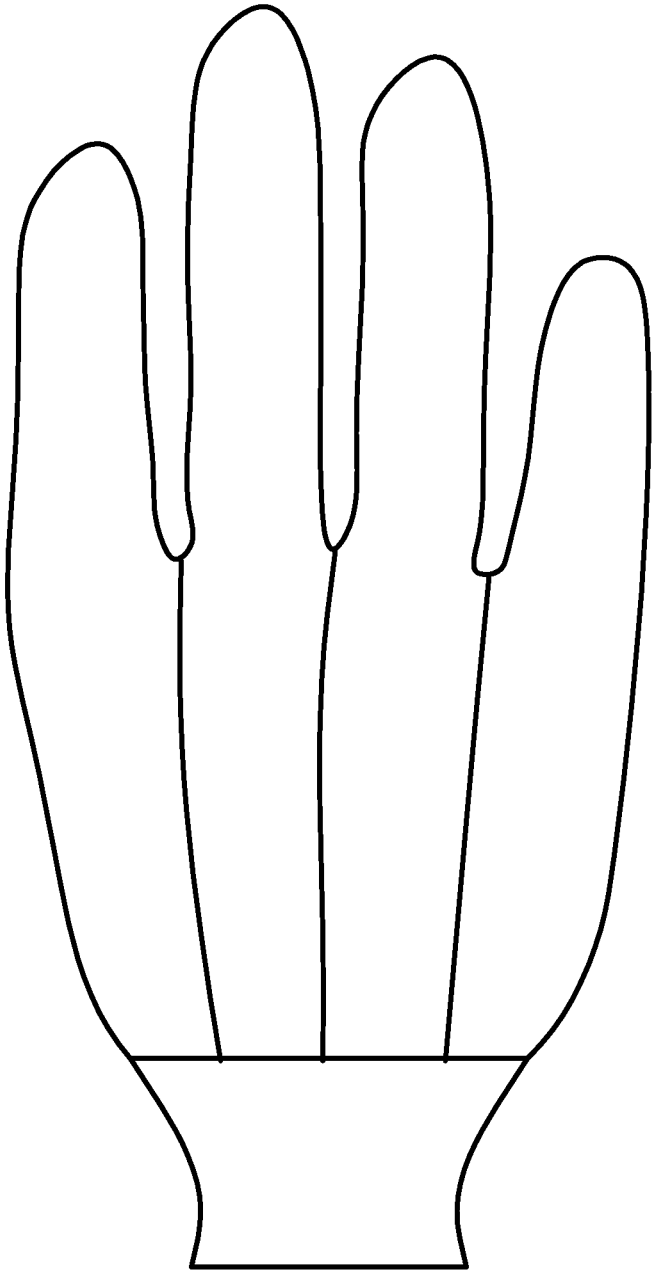
FIG. 2 is a schematic diagram of the back side of a right-hand glove according to an embodiment of the present patent application.
Figure 3:
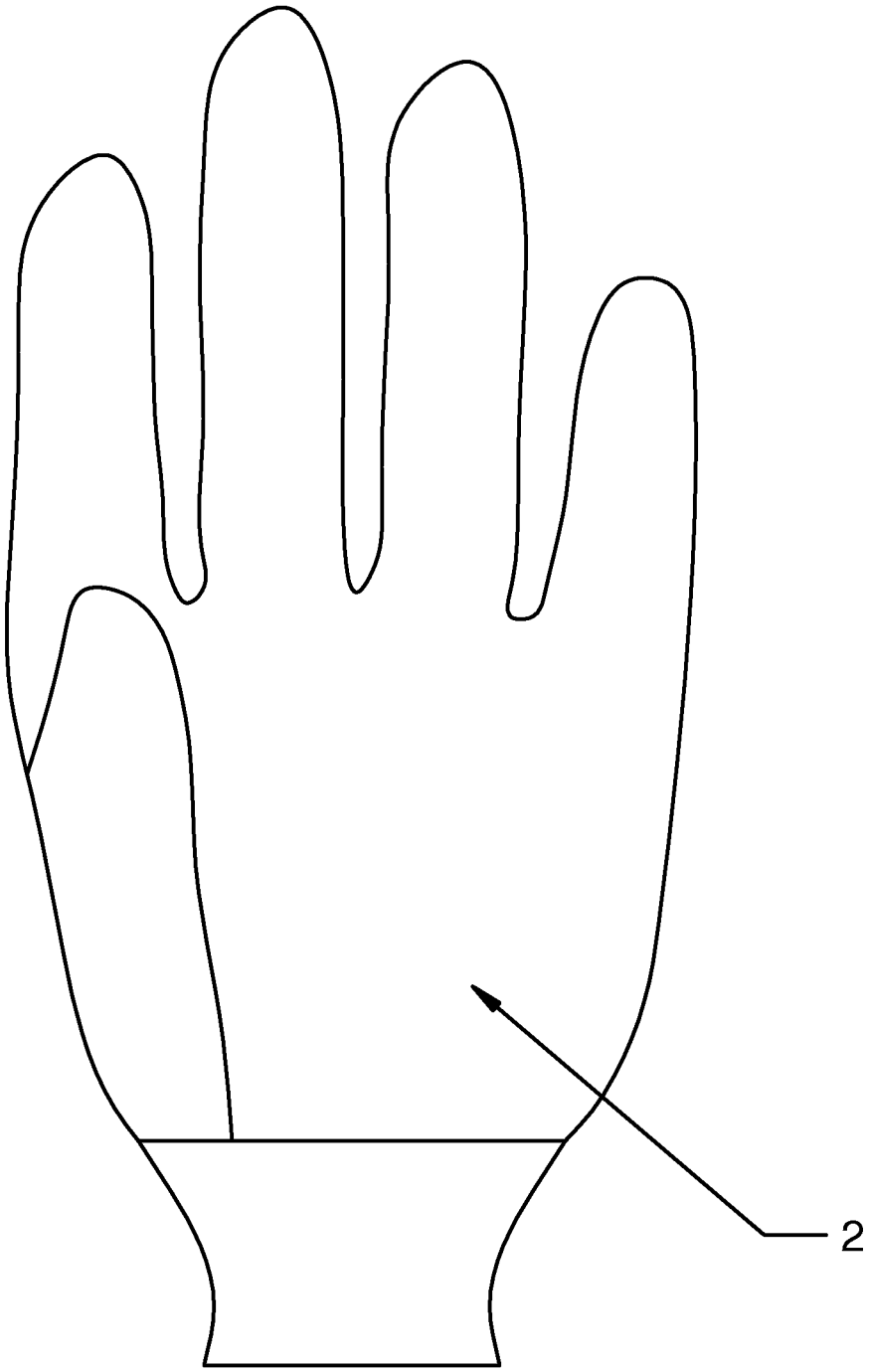
FIG. 3 is a schematic diagram of the palm side of the left-hand glove according to an embodiment of the present patent application.
Figure 4:
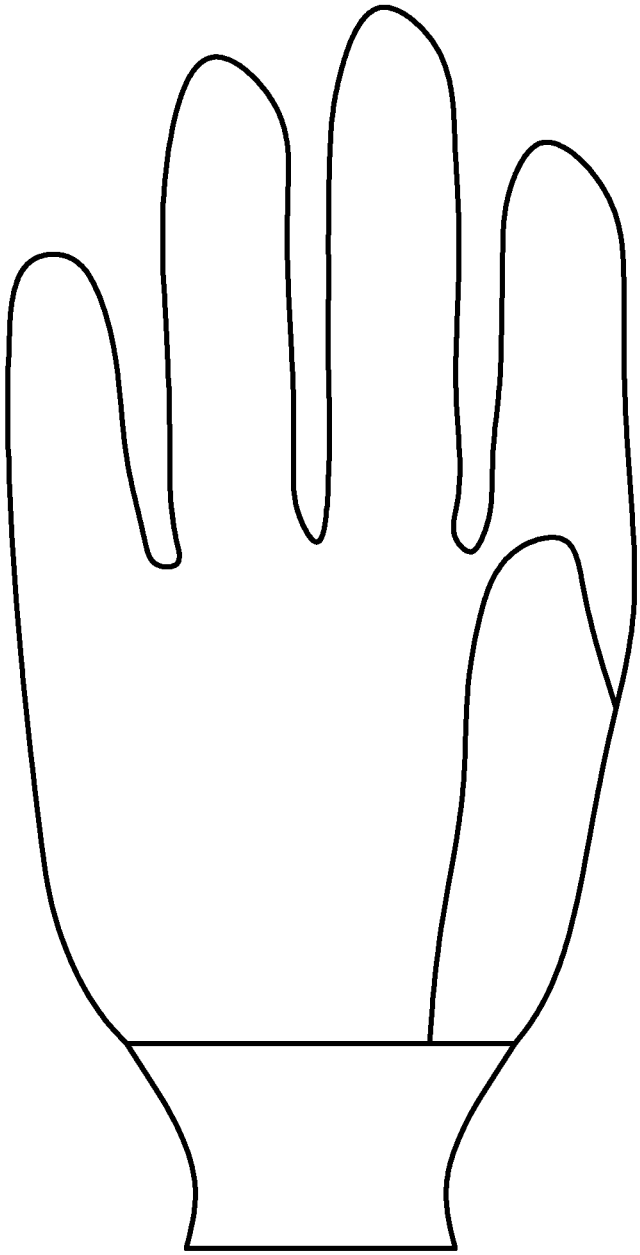
FIG. 4 is a schematic diagram of the palm side of the right-hand glove according to an embodiment of the present patent application.
Figure 5:
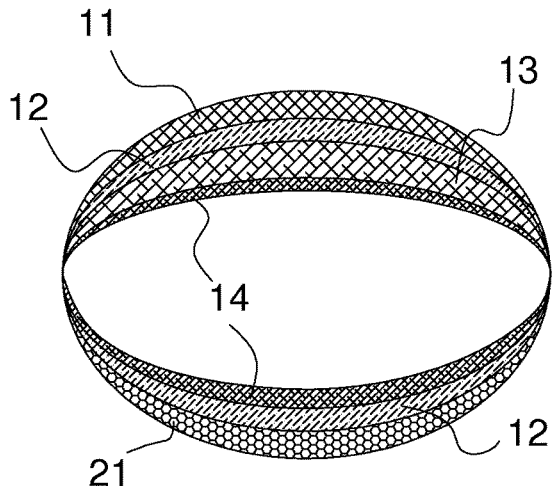
FIG. 5 is an enlarged cross-section view along A-A of FIG. 1.
Figure 6:
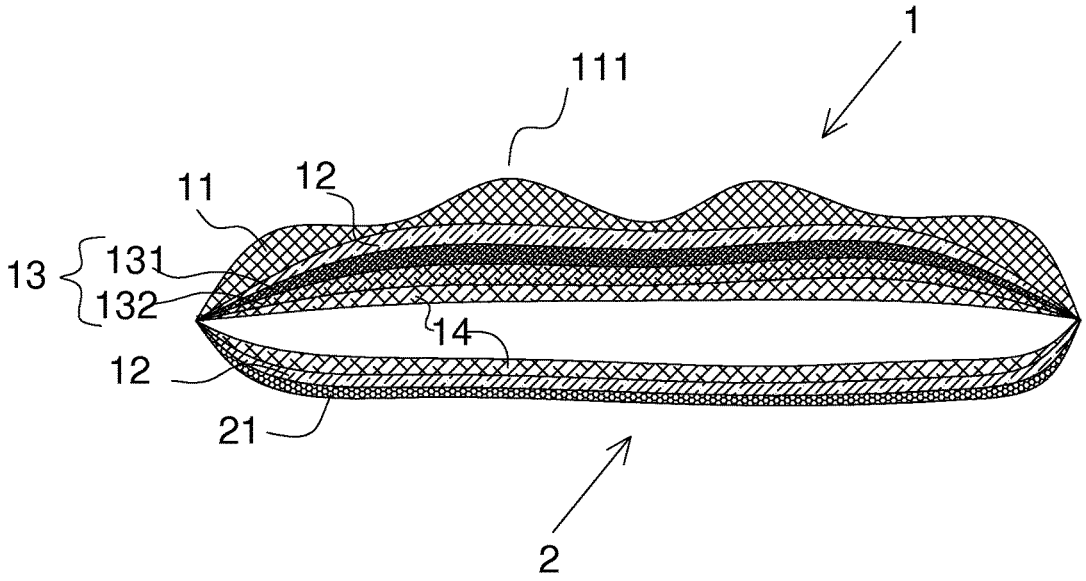
FIG. 6 is a cross-section view along B-B of FIG. 1.
Figure 7:
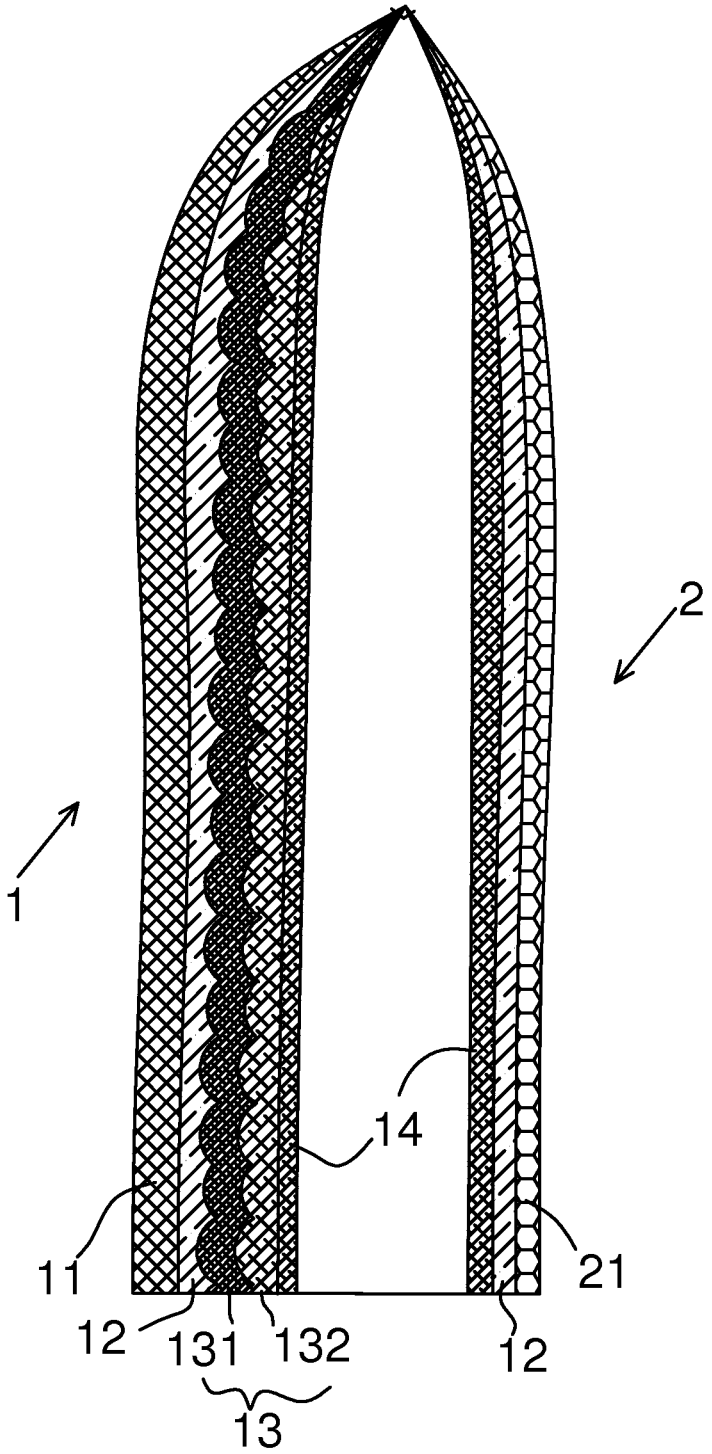
FIG. 7 is a cross-section view along C-C of FIG. 1.

FIGS. 1-4 are schematic diagrams of the glove according to an embodiment of the present patent application. FIGS. 1 and 3 are schematic diagrams of the back and palm sides of a left-hand glove, respectively. FIGS. 2 and 4 are schematic diagrams of the back and palm sides of a right-hand glove, respectively. Since a left-hand glove and a right-hand glove are mirror image of one another, structure of the glove of the present patent application is described by reference to the left-hand glove only by way of example.

Referring to FIGS. 1-7, the glove of the present patent application includes a first part 1 to cover the back side of a hand and a second part 2 to cover the palm side of the hand. A space for placing the hand is formed between the first part 1 and the second part 2. That is, the first part 1 and the second part 2 are joined together along the sides to form the glove. In the present embodiment, the first part 1 of the glove includes an outermost flame retardant polyester spandex layer 11, a thermoplastic polyurethane waterproof membrane 12 adjacent to the flame retardant polyester spandex layer 11, and an innermost cotton polyester knit layer 14. The first part 1 further includes a dual density pad layer 13 made of ethylene vinyl acetate (EVA) and low density polyethylene (LDPE). The dual density pad layer 13 is sandwiched between the thermoplastic polyurethane waterproof membrane 12 and the cotton polyester knit layer 14. The dual density pad layer 13 includes a higher density layer 131 adjacent to the thermoplastic polyurethane waterproof membrane 12 and a lower density layer 132 adjacent to the cotton polyester knit layer 14. The density of the higher density layer 131 is higher than that of the lower density layer 132. The second part 2 includes an outermost flame retardant cotton canvas layer 21, an innermost cotton polyester knit layer 14, and a thermoplastic polyurethane waterproof membrane 12 sandwiched between the flame retardant cotton canvas layer 21 and the cotton polyester knit layer 14.

Figure 8:
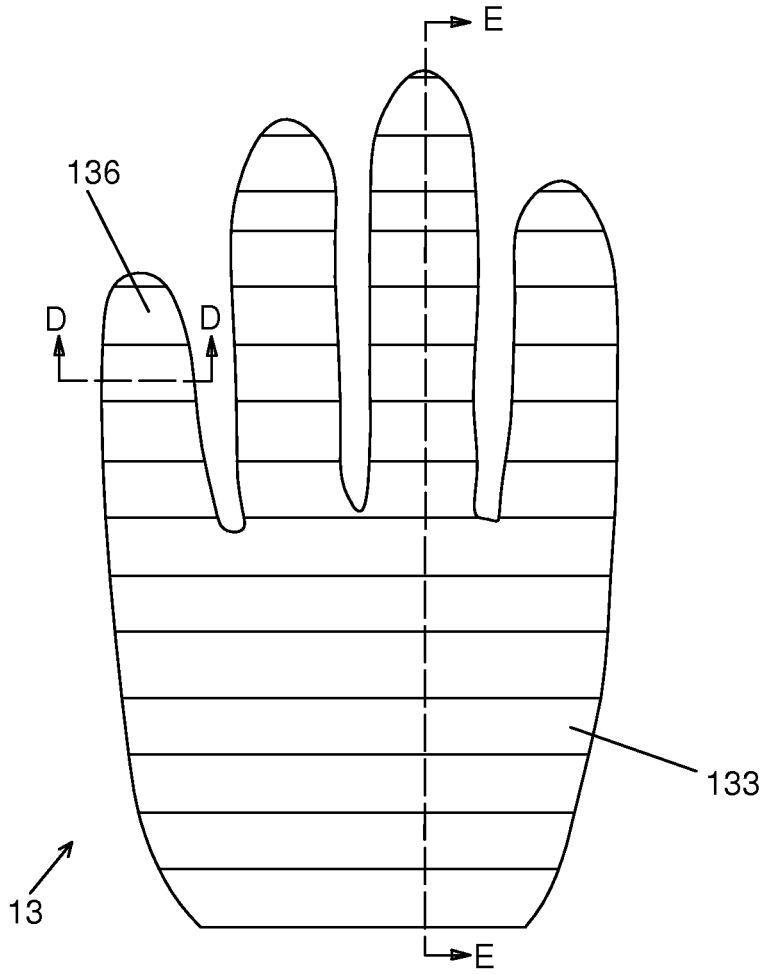
FIG. 8 is a schematic diagram of a pad layer of a left-hand glove according to an embodiment of the present patent application.
Figure 9:
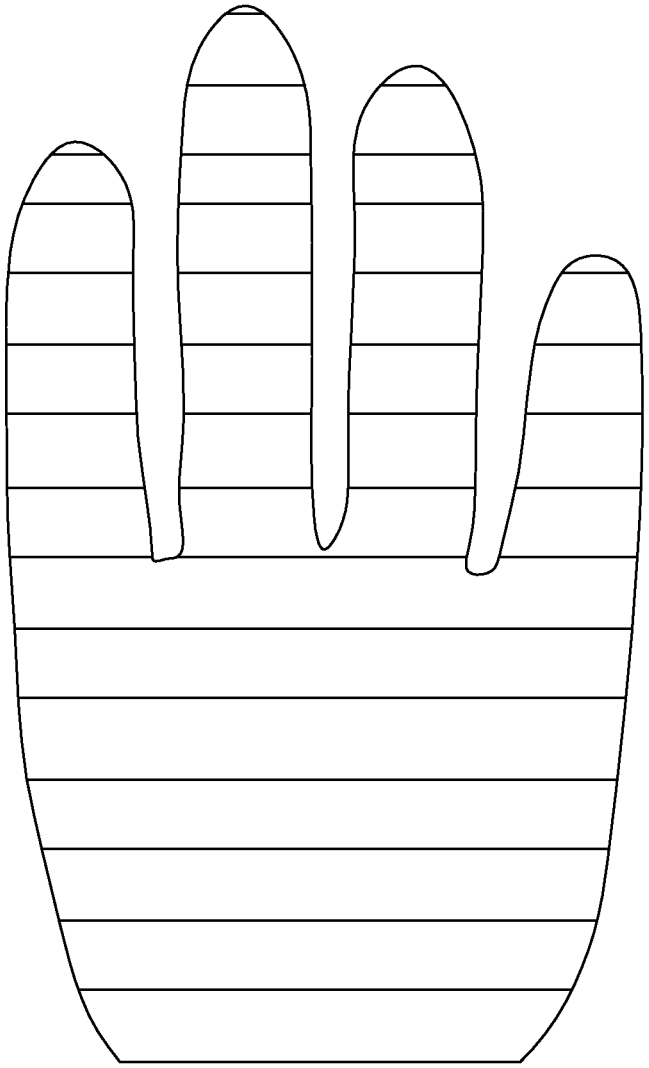
FIG. 9 is a schematic diagram of a pad layer of a right-hand glove according to an embodiment of the present patent application.
Figure 10:
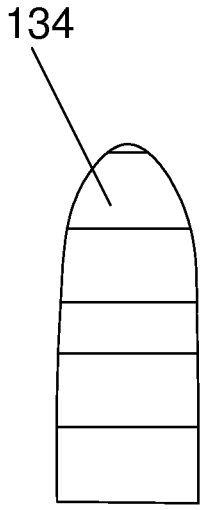
FIG. 10 is a schematic diagram of a thumb portion of a pad layer of a left-hand glove according to an embodiment of the present patent application.
Figure 11:
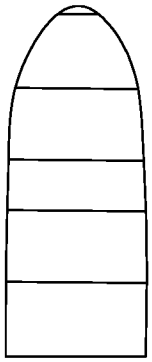
FIG. 11 is a schematic diagram of a thumb portion of a pad layer of a right-hand glove according to an embodiment of the present patent application.
Figure 12:
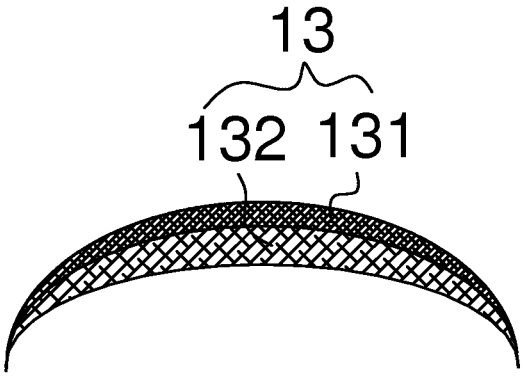
FIG. 12 is an enlarged cross-section view along D-D of FIG. 9.
Figure 13:
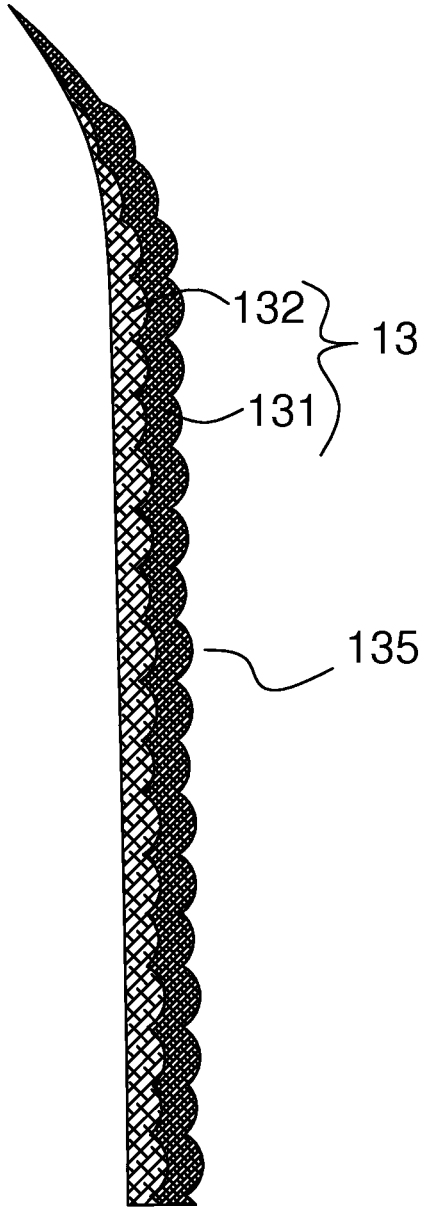
FIG. 13 is a cross-section view along E-E of FIG. 9.

FIGS. 8-13 illustrate the specific structures of the dual density pad layer 13 in the first part 1 of the glove of the present patent application. FIGS. 8 and 9 show the pad layers of left-hand and right-hand gloves, respectively, while FIGS. 10 and 11 show the thumb portions of pad layers of left-hand and right-hand gloves, respectively. FIGS. 12 and 13 show the corresponding cross-sectional views. The dual density pad layer 13 includes a back portion 133, four finger portions 136 at the front of the back portion 133, and a thumb portion 134 separated from the back portion 133. Each finger portion 136 has a curved cross-section half surrounding the back side of the finger. The outer surface of the higher density layer 131 and the lower density layer 132 of the dual density pad layer 13 have lateral protrusions 135 extending laterally. The lateral protrusions are connected to one another longitudinally. The higher density layer extends continuously over the entire outer surface of the lower density layer such that the lateral protrusion on the higher density layer and the lower density layer of the dual density pad layer generally align on top of one another. The shape of the dual density pad layer 13 is ergonomically designed with excellent impact resistance and comfort.

The lower density layer 132 of the dual density pad layer 13 is softer than the higher density layer 131 so to promote comfort, while the higher density layer 131 can facilitate good impact resistance. The dual density pad layer 13 can provide excellent impact resistance and absorption of shock as well as maximum protection to hand and fingers.

The outside of the first part 1 of the glove is the flame retardant polyester spandex layer 11, which is flame retardant, wearable, and flexible. It can provide excellent protection and prolong the service life of the glove. Furthermore, the outside of the first part 1 has longitudinal protrusions 111 extending longitudinally. That is, the outer surface of the flame retardant polyester spandex layer 11 may have longitudinal protrusions 111, for example, four longitudinal protrusions 111. Each longitudinal protrusion 111 is made from a longitudinally extended flame retardant polyester spandex strip, to improve comfort of the glove.

The outside of the second part 2 is the flame retardant cotton canvas layer 21, which has flame retardant property, a rough surface, and good anti-skid property, facilitates various work and has good durability.

Both the first part 1 and the second part 2 of the glove have a thermoplastic polyurethane waterproof membrane 12, offering good waterproof property to the glove and allowing the glove to be used under wet or humid environments.

In addition, both the innermost layers of the first part 1 and the second part 2 are cotton polyester knit layer 14, which has good moisture absorption and thermal insulation properties and a certain degree of elasticity, is suitable for direct contact with hands, improving comfort of the glove.

The glove of the present patent application, with the combination of materials of different material properties, shows good impact resistance and better comfort while enhancing protection of the glove.

The above with references to the drawings has provided a detailed description of the present patent application. However, it should be understood that the present patent application is not limited to the abovementioned embodiments. The abovementioned embodiments are merely illustrative and should not be interpreted as limiting the scope of the patent application. It will be understood by those skilled in the art that, under the enlightenment of the present patent application, many other possible modifications and variations can be made, without departing from the purposes and the protection scope of the claims of the present patent application, and fall within the true scope of the patent application.

What is claimed is:

1. A glove comprising:

a first part to cover a back side of a hand; and a second part to cover a palm side of the hand;

wherein the first part and the second part form a space for placing the hand;

wherein the first part comprises an outermost flame retardant polyester spandex layer, a thermoplastic polyurethane waterproof membrane adjacent to the flame retardant polyester spandex layer, an innermost cotton polyester knit layer, and a dual density pad layer made of ethylene vinyl acetate and low density polyethylene sandwiched between the thermoplastic polyurethane waterproof membrane and the cotton polyester knit layer;

the dual density pad layer comprises a single continuous higher density layer adjacent to the thermoplastic polyurethane waterproof membrane and a single continuous lower density layer adjacent to the cotton polyester knit layer; a density of the higher density layer is higher than that of the lower density layer;

the dual density pad layer comprises a back portion, four finger portions at a front of the back portion, and a thumb portion separated from the back portion;

each finger portion comprises a curved cross-section half surrounding a back side of the finger;

a continuous outer surface of the higher density layer and the lower density layer of the dual density pad layer comprises lateral protrusions extending laterally formed on the continuous outer surface of the higher density layer and the lower density layer; wherein the lateral protrusions are connected to one another longitudinally; wherein the higher density layer extends continuously over an entire outer surface of the lower density layer such that the lateral protrusion on the higher density layer and the lower density layer of the dual density pad layer generally align on top of one another an outer surface of the first part comprises longitudinal protrusions extending longitudinally; and the second part comprises an outermost flame retardant cotton canvas layer, an innermost cotton polyester knit layer, and a thermoplastic polyurethane waterproof membrane sandwiched between the flame retardant cotton canvas layer and the cotton polyester knit layer.

2. A glove comprising:

a first part to cover a back side of a hand; and a second part to cover a palm side of the hand;

wherein the first part and the second part form a space for placing the hand;

wherein the first part comprises an outermost flame retardant polyester spandex layer, a thermoplastic polyurethane waterproof membrane adjacent to the flame retardant polyester spandex layer, an innermost cotton polyester knit layer, and a dual density pad layer sandwiched between the thermoplastic polyurethane waterproof membrane and the cotton polyester knit layer;

the dual density pad layer comprises a single continuous higher density layer adjacent to the thermoplastic polyurethane waterproof membrane and a single continuous lower density layer adjacent to the cotton polyester knit layer; and a density of the higher density layer is higher than that of the lower density layer;

the dual density pad layer comprises a back portion, four finger portions at a front of the back portion, and a thumb portion separated from the back portion;

a continuous outer surface of the higher density layer and the lower density layer of the dual density pad layer comprises lateral protrusions extending laterally formed on the continuous outer surface of the higher density layer and the lower density layer; wherein the lateral protrusions are connected to one another longitudinally; wherein the higher density layer extends continuously over an entire outer surface of the lower density layer such that the lateral protrusion on the higher density layer and the lower density layer of the dual density pad layer generally align on top of one another an outer surface of the first part comprises longitudinal protrusions extending longitudinally; and the second part comprises an outermost flame retardant cotton canvas layer, an innermost cotton polyester knit layer, and a thermoplastic polyurethane waterproof membrane sandwiched between the flame retardant cotton canvas layer and the cotton polyester knit layer.

3. The glove according to claim 2, wherein each finger portion comprises a curved cross-section half surrounding a back side of the finger.

4. The glove according to claim 2, wherein the outer surface of the first part comprises longitudinal protrusions extending longitudinally.

5. The glove according to claim 2, wherein the dual density pad layer is made of ethylene vinyl acetate and low density polyethylene.

6. A glove comprising:

a first part to cover a back side of a hand; and a second part to cover a palm side of the hand;

wherein the first part and the second part form a space for placing the hand;

wherein the second part comprises an outermost flame retardant cotton canvas layer, an innermost cotton polyester knit layer, and a thermoplastic polyurethane waterproof membrane sandwiched between the flame retardant cotton canvas layer and the cotton polyester knit layer wherein the first part comprises an outermost flame retardant polyester spandex layer, a thermoplastic polyurethane waterproof membrane adjacent to the flame retardant polyester spandex layer, an innermost cotton polyester knit layer, and a dual density pad layer sandwiched between the thermoplastic polyurethane waterproof membrane and the cotton polyester knit layer;

the dual density pad layer comprises a single continuous higher density layer adjacent to the thermoplastic polyurethane waterproof membrane and a single continuous lower density layer adjacent to the cotton polyester knit layer; and a density of the higher density layer is higher than that of the lower density layer;

the dual density pad layer comprises a back portion, four finger portions at a front of the back portion, and a thumb portion separated from the back portion;

a continuous outer surface of the higher density layer and the lower density layer of the dual density pad layer comprise lateral protrusions extending laterally formed on the continuous outer surface of the higher density layer and the lower density layer; wherein the lateral protrusions are connected to one another longitudinally; wherein the higher density layer extends continuously over an entire outer surface of the lower density layer such that the lateral protrusion on the higher density layer and the lower density layer of the dual density pad layer generally align on top of one another.

7. The glove according to claim 6, wherein each finger portion comprises a curved cross-section half surrounding a back side of the finger.

8. The glove according to claim 6, wherein the outer surface of the first part comprises longitudinal protrusions extending longitudinally.

9. The glove according to claim 6, wherein the dual density pad layer is made of ethylene vinyl acetate and low density polyethylene.

* * * * *